United States Patent [19]

Laux et al.

[11] 4,253,410

[45] Mar. 3, 1981

[54] RELIEF BRICKWORK OVER OPENING IN REFRACTORY BRICK WALL

[75] Inventors: Walter Laux; Martin Zettel, both of Wiesbaden; Erich Ambrosius, Wiesbaden-Schierstein, all of Fed. Rep. of Germany

[73] Assignee: Didier-Werke AG, Wiesbaden, Fed. Rep. of Germany

[21] Appl. No.: 72,601

[22] Filed: Sep. 5, 1979

[30] Foreign Application Priority Data

Sep. 12, 1978 [DE] Fed. Rep. of Germany ..... 2839610

[51] Int. Cl.[3] ..... F23M 5/06; C21B 9/00

[52] U.S. Cl. ..... 110/331; 110/333; 110/336; 432/214; 432/247; 432/250

[58] Field of Search ..... 432/214, 247, 250; 110/331, 333, 336

[56] References Cited

U.S. PATENT DOCUMENTS

| | | | |
|---|---|---|---|
| 190,132 | 5/1877 | Dickson | 432/247 |
| 804,294 | 11/1905 | Young | 432/242 |
| 2,295,352 | 9/1942 | MacDonald | 110/336 |
| 4,212,636 | 7/1980 | Pavlak | 432/250 |

OTHER PUBLICATIONS

Fachberichte, Huettenpraxis, Metallweiterverarbeitung, Technical Reports of Metallurgical Practice and Metal Treating, 1977, pp. 956–957.

*Primary Examiner*—John J. Camby

*Attorney, Agent, or Firm*—Wenderoth, Lind & Ponack

[57] ABSTRACT

A refractory brickwork wall having an opening therethrough has incorporated therein, at a position above the opening, a relief brickwork configuration in the form of a gable or roof. The relief brickwork includes a plurality of relief bricks each having an upper inclined surface, a lower inclined surface and a lower, generally horizontal step surface. The relief bricks are arranged one above the other in an inclined formation with the lower inclined surface of the upper relief brick of each pair of adjacent relief bricks resting on the upper inclined surface of the lower relief brick of such pair of adjacent relief bricks, and with the upper relief brick of each pair of adjacent relief bricks being partially offset in a horizontal direction from the lower relief brick of such pair of adjacent relief bricks. The horizontal step surface of the upper relief brick of each adjacent pair of relief bricks extends horizontally at least partially beyond the lower relief brick of such pair of relief bricks and faces a surface of one of the refractory bricks of the wall and defines therewith a joint. All such joints are filled with a compressible fireproof material.

20 Claims, 6 Drawing Figures

RELIEF BRICKWORK OVER OPENING IN REFRACTORY BRICK WALL

BACKGROUND OF THE INVENTION

The present invention is directed to relief brickwork incorporated in a refractory brickwork wall, particularly over openings therethrough. More particularly, the present invention is directed to such relief brickwork over a hot blast exit opening in a refractory brickwork wall of a combustion chamber of a hot blast stove.

This general type of relief brickwork is known and depicted in the journal "Fachberichte, Huettenpraxis, Metallweiterverarbeitung", Technical Reports of Metallurgical Practice and Metal Treating, 1977, pages 956–957. This type of relief brickwork is intended to protect the hot blast exit opening of a hot blast stove from deformations which arise due to vertical stresses, for example deadweight, of the shaft brickwork and the dome of the hot blast stove, as well as from tensile or compressive stresses due to temperature changes in the brickwork. The type of relief brickwork shown in the above journal is in the shape of a gable and is formed of bricks which are components of plural layers of bricks of the wall. Such design is capable of entirely withstanding neither horizontal shifting forces due to temperature changes nor vertical load forces due to the weight of the upper portions of the stove. This is due to the fact that horizontally loaded relief bricks between the horizontal joints of the brickwork wall in the direction of the filling brickwork interior to the the relief gable can be shifted, and also due to the fact that other vertical forces from the gable of relief bricks can be transmitted directly to the brickwork of the wall within the area of the gable.

SUMMARY OF THE INVENTION

With the above discussion in mind, it is the object of the present invention to provide an improved relief brickwork arrangement which is effective to efficiently protect against excessive stresses.

It is a more specific object of the present invention to provide an improved refractory brickwork wall having an opening therethrough, particularly a wall of a combustion chamber of a hot blast stove having a hot blast exit opening therethrough, and incorporating an improved relief brickwork configuration, whereby both vertically directed and horizontally directed stresses are absorbed by the relief brickwork and are not transmitted to the opening in the refractory brickwork wall.

These objects are achieved in accordance with the present invention by providing a plurality of relief bricks arranged in the refractory bricks of the wall in the configuration of a gable or roof extending above the opening, each relief brick having an upper inclined surface, a lower inclined surface and a lower, generally horizontal step surface. The relief bricks are arranged one above the other in an inclined formation, with the lower inclined surface of the upper relief brick of each pair of adjacent relief bricks resting on the upper inclined surface of the lower relief brick of such pair of adjacent relief bricks, and with the upper relief brick of each pair of adjacent relief bricks being partially offset in a horizontal direction from the lower relief brick of such pair of adjacent relief bricks. The horizontal step surface of the upper relief brick of each adjacent pair of relief bricks extends horizontally at least partially beyond the lower relief brick of such pair of relief bricks and faces a surface of one of the refractory bricks of the wall and defines therewith a joint. All such joints between the horizontal step surfaces of the relief bricks and the respective refractory bricks of the brickwork wall are filled with a compressive fireproof material, for example fireproof felt. The relief bricks are arranged in two inclined formations which converge upwardly to form the gable or roof configuration. By this arrangement, the relief bricks interlock in a manner such that horizontally acting forces are absorbed and are kept from the refractory bricks of the wall which are arranged between the two converging formations of relief bricks. At the same time, the joints filled with compressible fireproof material form compressible joints between the horizontal step surfaces of the relief bricks and the refractory bricks. Thereby, vertical stresses are prevented from being directed toward the opening which is positioned below the gable configuration and are instead transmitted along the inclined formations of relief brickwork away from and past the opening. Accordingly, the refractory brickwork wall, particularly that portion thereof over the hot blast exit opening in a wall of a combustion chamber of a hot blast stove is maintained free of horizontal and vertical stresses which would otherwise build up and cause deformation of the hot blast exit opening. Thus, the service life of the hot blast stove is prolonged.

In accordance with a further feature of the present invention there are provided first and second support bricks supported on the refractory bricks of the wall, one each of the support bricks being positioned beneath the lowermost relief brick of each inclined formation thereof. Each support brick has an upper inclined surface having resting thereon the lower inclined surface of the lowermost relief brick of the respective inclined formation.

In accordance with a further feature of the present invention there are provided first and second keystone or center closing bricks, one each being positioned above the uppermost relief brick of each inclined formation. Each center closing brick has a lower inclined surface resting on the upper inclined surface of the uppermost relief brick of the respective inclined formation. The two center closing bricks have side surfaces which preferably abut at a position above the center of the opening through the brickwork wall. The two center closing bricks have lower, generally horizontal step surfaces which extend at least partially beyond the respective uppermost relief bricks and which face surfaces of the refractory bricks of the brickwork wall, thereby forming joints which are filled with a compressible fireproof material, in a manner similar to the joints formed by the horizontal step surfaces of the relief bricks and the refractory bricks of the brickwork wall.

The center closing bricks and the support bricks may have vertical heights equal to the height of two layers of refractory bricks. Alternatively, the support bricks may have a vertical height equal to the height of one layer of refractory bricks, and the center closing bricks may have vertical heights between one and two times the height of a layer of refractory bricks.

Similarly, each of the relief bricks may have a total vertical height equal to the height of two layers of refractory bricks, or alternatively a total vertical height between one and two times the height of a layer of refractory bricks.

In accordance with a further feature of the present invention, each relief brick has a vertical side surface forming a convex corner with the respective lower horizontal step surface. Such convex corner may be received in a recess in a respective refractory brick of a single layer of refractory bricks, or alternatively such convex corner may be received in a concave corner formed by surfaces of refractory bricks of two adjacent layers of refractory bricks.

The vertical side surfaces of the relief bricks may extend downwardly from the respective upper inclined surfaces thereof. Alternatively, the vertical side surfaces of the relief bricks may extend downwardly from upper horizontal surfaces that join the respective upper inclined surfaces and the vertical side surfaces.

Preferably, the upper and lower inclined surfaces of each of the relief bricks extend parallel to each other.

In accordance with a further feature of the present invention, each upper and lower inclined surface of each relief brick may include a first portion having a shallow incline with respect to the horizontal and a second portion having a steep incline with respect to the horizontal.

BRIEF DESCRIPTION OF THE DRAWINGS

Other objects, features and advantages of the present invention will be apparent from the following detailed description, taken with the accompanying drawings, wherein.

DETAILED DESCRIPTION OF THE INVENTION

Figure 1:
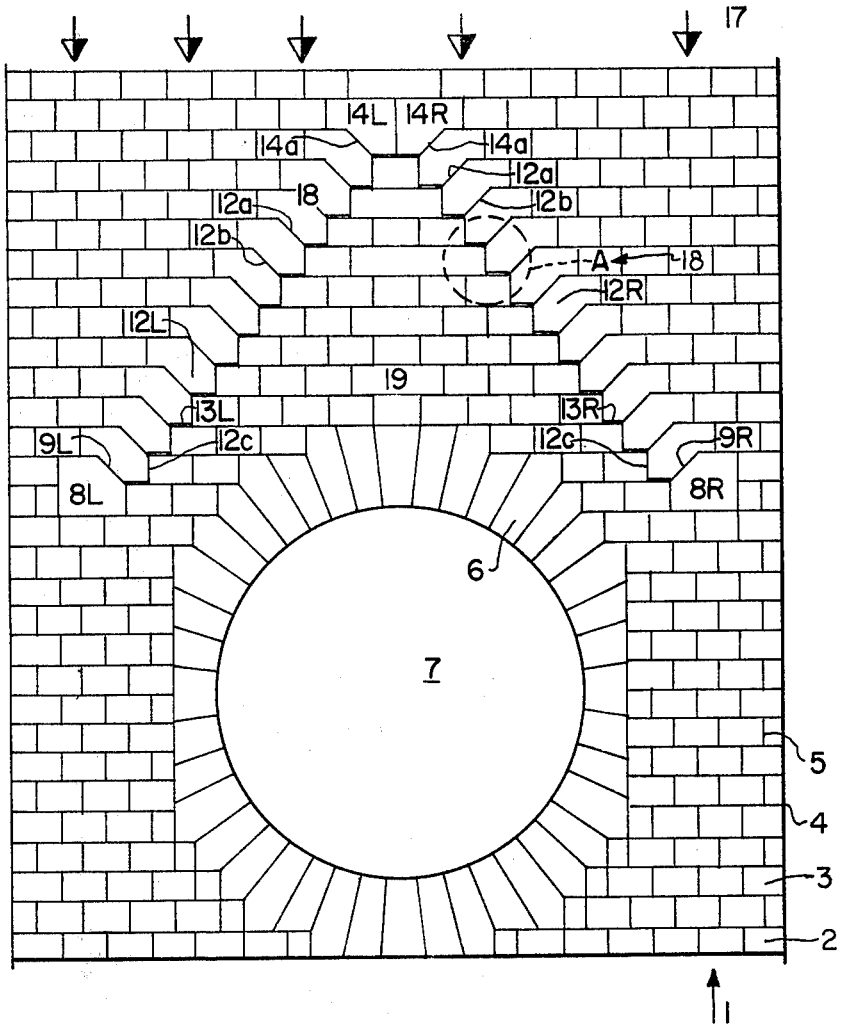
FIG. 1 is an elevation view, taken from the inside of the combustion chamber of a hot blast stove, illustrating a refractory brickwork wall having extending therethrough a hot blast exit opening and incorporating the improved relief brickwork structure in accordance with one embodiment of the present invention.
Figure 2:
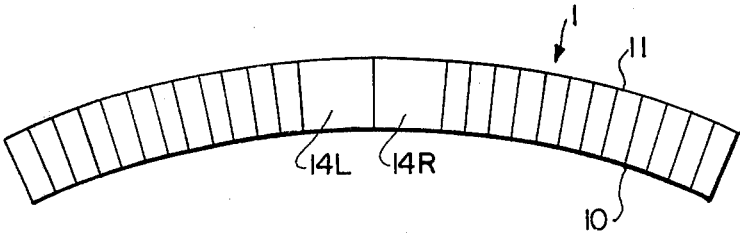
FIG. 2 is a plan view of the relief brickwork structure of FIG. 1.
Figure 3:
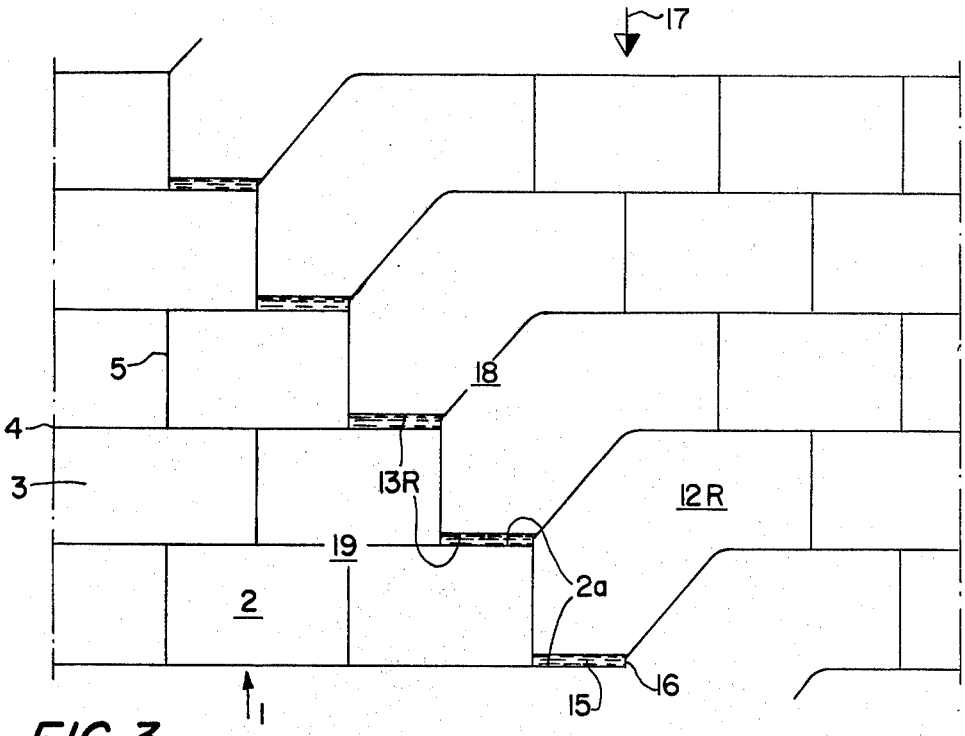
FIG. 3 is an enlarged view showing in more detail the area indicated A in FIG. 1.

With reference now to FIGS. 1 through 3, a first embodiment of the present invention will be described. The description herein will be made with reference to a refractory brickwork wall of a combustion chamber of a hot blast stove, such wall having a hot blast exit opening extending therethrough. It is to be understood however that the present invention is not specifically limited to employment in a hot blast stove, but rather that the improved relief brickwork configuration of the present invention is applicable to other types of walls, and particularly walls having openings extending therethrough.

A portion of a refractory brickwork wall 1 of the combustion chamber of a hot blast stove is formed by a plurality of refractory bricks 2 arranged in horizontally extending layers or rows 3, with horizontal joints 4 between adjacent rows, and with staggered vertical joints 5 between adjacent bricks. The wall 1 formed in such manner has extending therethrough a hot blast exit opening 7 which is defined by a ring of specially shaped refractory bricks 6. Such construction in and of itself is conventional, and it will be understood by those skilled in the art that the present invention is equally applicable to brickwork wall configurations other than that specifically illustrated.

In accordance with the present invention there is provided a relief brickwork configuration in the form of two inclined and upwardly converging formations 18 in the shape of a gable or roof which is incorporated within the refractory brickwork wall at a position above opening 7. More particularly, such relief brickwork includes first and second thrust or support bricks 8L and 8R on the left and right sides of the opening 7, at vertical positions approximately at the level of the upper bricks 6 defining the opening 7. Each refractory support brick 8R and 8L has a respective upper inclined surface 9R and 9L, respectively. Extending in an upwardly inclined and converging manner from the respective support bricks are a plurality of relief bricks 12L and 12R. Each relief brick 12L and 12R has an upper inclined surface 12*a* and a lower inclined surface 12*b*. The relief bricks are arranged one above the other in the inclined and converging formations 18, with the lower inclined surface 12*b* of the upper relief brick of each pair of adjacent relief bricks resting on the upper inclined surface 12*a* of the lower relief brick of such pair of adjacent relief bricks. Furthermore, the upper relief brick of each such pair of adjacent relief bricks is partially offset in a horizontal direction from the lower relief brick of such pair of adjacent relief bricks.

Furthermore, each relief brick 12L and 12R has a lower, generally horizontal step surface 13L and 13R, respectively. The horizontal step surface 13L or 13R of the upper relief brick of each adjacent pair of relief bricks extends horizontally at least partially beyond the lower relief brick of such pair of adjacent relief bricks and, as shown in more detail in FIG. 3, faces a respective surface 2*a* of one of the refractory bricks 2 and defines therewith a vertical joint 16 which is filled with a compressible fireproof material 15, for example fireproof felt.

Furthermore, there are provided first and second keystone or center closing bricks 14L and 14R positioned above the uppermost of the relief bricks 12L and 12R, respectively, of each of the inclined formations 18 of relief bricks. Each center closing brick 14L and 14R has a lower inclined surface 14*a* resting on the upper inclined surface 12*a* of the uppermost relief bricks 12L and 12R, respectively.

As shown in FIG. 2, the support bricks, relief bricks and center closing bricks of the relief brickwork of the present invention extend entirely through the refractory brickwork wall, i.e. from the inner side or surface 10 thereof to the outer side or surface 11 thereof.

The center closing bricks 14L and 14R have adjacent sides surfaces which abut at a position above the center of the opening 7 through the brickwork wall 1. Furthermore, the center closing bricks 14L and 14R have lower, generally horizontal step surfaces which extend at least partially beyond the respective uppermost relief bricks 12L and 12R, respectively, and face a refractory brick surface, thereby forming vertically spaced joints therewith, such joints being filled with compressible fireproof material, for example fireproof felt. These joints are similar in configuration and function with the joints 16 described above and shown in FIG. 3.

In the embodiment of FIG. 1, the upper inclined surfaces 9L and 9R of the support bricks 8L and 8R, respectively, the upper and lower inclined surfaces 12*a* and 12*b*, respectively of the relief bricks 12L and 12R, and the lower inclined surfaces 14*a* of the center closing bricks 14L and 14R all extend substantially parallel to each other at an angle inclined to the horizontal, such angle preferably being approximately 45°. Furthermore, in accordance with the embodiment of FIG. 1, all of the support bricks 8L and 8R, the relief bricks 12L and 12R and the center closing bricks 14L and 14R each have a vertical height equal to the height of two of the layers 3 of refractory bricks 2, and thereby each bridge over at least one of the horizontal joints 4.

Furthermore, each relief brick 12L and 12R has a substantially vertical side surface **12*c* which forms a convex corner with the respective lower horizontal step surface 13L and 13R. Such convex corner is received in a concave corner formed by surfaces of refractory bricks 2 of two adjacent layers 3. In FIG. 1, the vertical side surfaces 12*c* extend downwardly from the respective upper inclined surfaces 12*a***.

By the above arrangement, it will be apparent that vertical load forces, shown by arrows 17 in FIG. 1, for example due to deadweight of the upper structure of the oven, will be received by the center closing bricks 14L and 14R and will then be directed in downwardly diverging directions through the relief bricks 12L and 12R and the support bricks 8L and 8R. Such diverging of vertical forces prevents such vertical forces from being directed toward the refractory bricks 19 positioned between the two formations 18. Further, it will be apparent that due to the engaging inclined surfaces discussed above and illustrated in FIG. 1, horizontal forces will be absorbed by the relief brickwork structure and will not be directed to the refractory brickwork 19. It will further be apparent that the compressible fireproof material 15 filling the joints 16 will prevent the horizontal step surfaces from transferring components of vertical forces 17 to the respective underlying refractory bricks 2 of the refractory brickwork 19. Since the refractory brickwork 19 is thereby not subjected to either horizontally or vertically directed forces, then the hot blast exit opening 7 will not be subjected to such forces, and thereby will not become deformed. Thus, the service life of the wall 1 will be enhanced. It will be apparent that the relief brickwork configuration of the present invention essentially causes forces 17 to be directed or passed around the opening 7.

Figure 4:
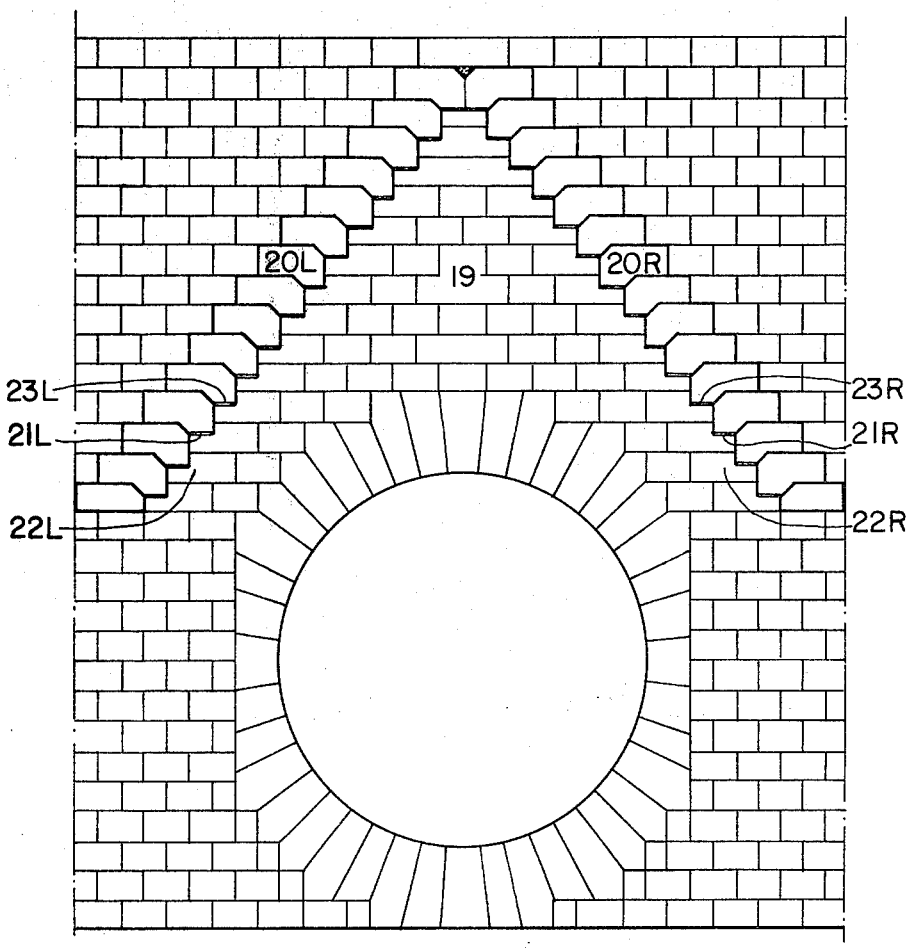
FIGS. 4 through 6 are views similar to FIG. 1 but illustrating further embodiments of the present invention.
Figures 5, 6:
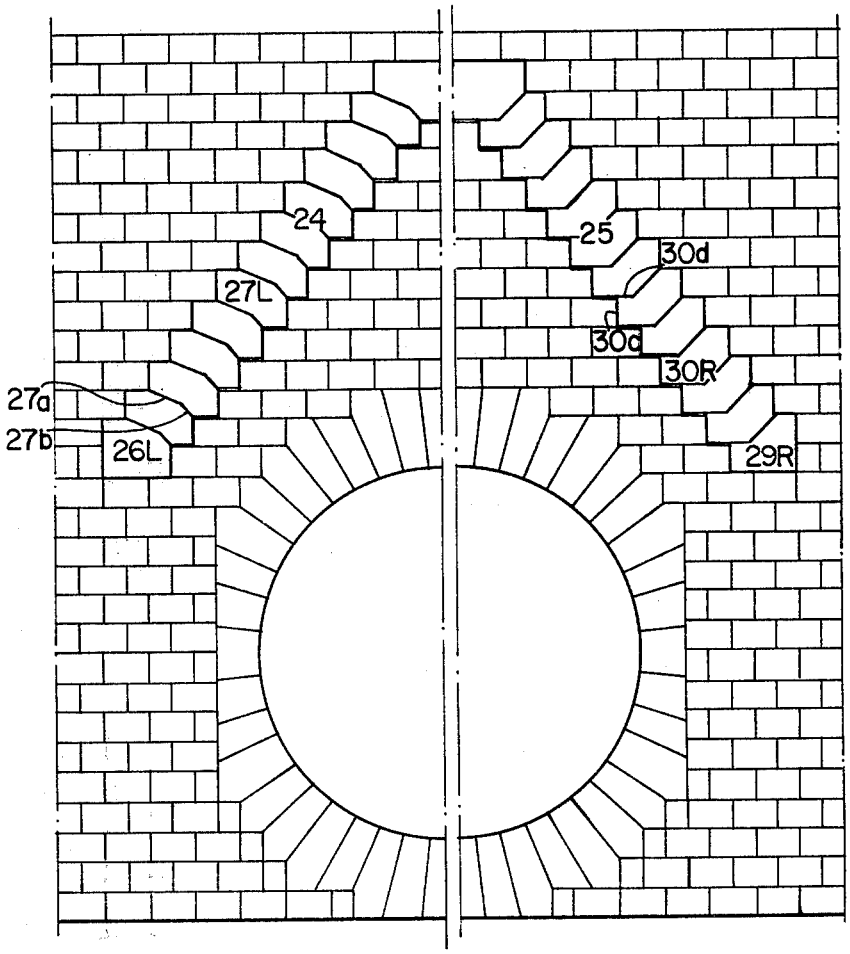

With reference now to FIGS. 4 through 6, additional embodiments of the present invention will be described.

The relief brickwork configuration of the embodiment of FIG. 4 is generally similar to that of FIG. 1. However, the lower support bricks have a vertical height equal to the height of a single layer 3 of refractory bricks 2. Furthermore, the vertical height of the relief bricks 20L and 20R and of the center closing bricks is less than that of the embodiment of FIG. 1, and is between one and two times the height of a layer 3 of refractory bricks 2. Thus, the convex corners formed by the respective horizontal step surfaces 23L and 23R of the relief bricks and the adjacent respective vertical sides surfaces engage in respective recesses 21L and 21R in respective underlying refractory bricks 22L and 22R. In all other respects, the embodiment of FIG. 4 is similar to the embodiment of FIG. 1.

With reference now to FIG. 5, which shows only the left side of a wall configuration, there is shown one inclined gable formation 24 including a support brick 26L, a plurality of relief bricks 27L and a center closing brick. In this embodiment, the upper inclined surface of the support brick 26L, the upper and lower inclined surfaces of each of the relief bricks 27L and the lower inclined surface of the center closing brick each have a first portion **27*a* having a relatively shallow incline with respect to the horizontal and a second portion 27*b* having a relatively steep incline with respect to the horizontal. In all other respects, the embodiment of FIG. 5 is similar to the embodiment of FIG. 1**.

With reference now to FIG. 6, wherein there is shown only the right side of the wall structure, an inclined relief brickwork formation 25 includes a support brick 29R, a plurality of relief bricks 30R and a center closing brick. The configuration of the embodiment of FIG. 6 differs from that of the embodiment of FIG. 1 in that the vertical side surfaces **30*c* of the relief bricks, and also the corresponding vertical side surface of the support brick, do not extend downwardly from the respective upper inclined surfaces, but rather extend downwardly from respective upper horizontal surfaces 30*d* that join the respective upper inclined surfaces with the respective vertical side surfaces 30*c*. In all other respects, the embodiment of FIG. 6 is similar to the embodiment of FIG. 1**.

It is of course to be understood that the wall configuration according to the embodiments of FIGS. 5 and 6 will include respective right-hand and left-hand portions which are mirror images to those portions illustrated.

It is also to be understood that as employed herein the terms "refractory", "brick", and "brickwork" are intended to convey their conventional meanings in the art.

Furthermore, it is to be understood that the various bricks forming the wall structure may be joined by conventional mortars as would be understood by those skilled in the art. Furthermore, the composition of the compressible fireproof material 15 will be understood to encompass any such material which is capable of compression within the area of joints 16 in the obvious manner intended and which has the necessary properties, for example fireproof properties, to have a useful life in the environment intended.

Although the present invention has been described and illustrated with respect to specific preferred features thereof, it will be understood by those skilled in the art that various modifications may be made without departing from the scope of the invention. Specifically, it is to be understood that the relief brickwork configuration of the present invention may be constructed of bricks with convex arcuate inclined surfaces.

What we claim is:

1. In a refractory brickwork wall, particularly of a combustion chamber of a hot blast stove, having therethrough an opening, such as a hot blast exit opening, said wall being formed of refractory bricks joined together at joints and a plurality of relief bricks arranged in said refractory bricks in the configuration of a gable or roof extending above said opening, the improvement wherein:

each said relief brick has an upper inclined surface, a lower inclined surface and a lower, generally horizontal step surface;

said relief bricks are arranged one above the other in an inclined formation, with the said lower inclined surface of the upper said relief brick of each pair of adjacent relief bricks resting on the said upper inclined surface of the lower said relief brick of said pair of adjacent relief bricks, and with said upper relief brick of each said pair of adjacent relief bricks being partially offset in a horizontal direction from said lower relief brick of said pair of adjacent relief bricks;

said horizontal step surface of said upper relief brick of each said adjacent pair of relief bricks extends horizontally at least partially beyond said lower relief brick of said pair of relief bricks and faces a surface of one of said refractory bricks and defines therewith a joint; and all of said joints between said horizontal step surfaces and said refractory bricks are filled with a compressible fireproof material.

2. The improvement claimed in claim 1, wherein said refractory bricks are arranged in horizontal layers with vertical joints between bricks, and with said layers being vertically stacked with horizontal joints therebetween.

3. The improvement claimed in claim 2, wherein said relief bricks are arranged in two said inclined formations which converge upwardly to form said gable or roof configuration.

4. The improvement claimed in claim 3, further comprising first and second support bricks supported on said refractory bricks, one each of said support bricks being positioned beneath the lowermost said relief brick of each said inclined formation of relief bricks, each said support brick having an upper inclined surface having resting thereon the said lower inclined surface of said lowermost relief brick.

5. The improvement claimed in claims 3 or 4, further comprising first and second center closing bricks, one each of said center closing bricks being positioned above the uppermost said relief brick of each said inclined formation of relief bricks, each said center closing brick having a lower inclined surface resting on the said upper inclined surface of said uppermost relief brick.

6. The improvement claimed in claim 5, wherein said center closing bricks each have side surfaces abutting at a position above the center of said opening through said brickwork wall.

7. The improvement claimed in claim 5, wherein said center closing bricks have lower, generally horizontal step surfaces extending at least partially beyond said uppermost relief bricks and facing a refractory brick surface, thereby forming joints which are filled with compressible fireproof material.

8. The improvement claimed in claim 5, wherein said center closing bricks have a vertical height equal to the height of two of said layers of refractory bricks.

9. The improvement claimed in claim 5, wherein said center closing bricks have a vertical height between one and two times the height of a said layer of refractory bricks.

10. The improvement claimed in claim 4, wherein said support bricks have a vertical height equal to the height of two said layers of refractory bricks.

11. The improvement claimed in claim 4, wherein said support bricks have a vertical height equal to the height of one of said layers of refractory bricks.

12. The improvement claimed in claim 2, wherein each said relief brick has a vertical side surface forming a convex corner with said respective lower horizontal step surface.

13. The improvement claimed in claim 12, wherein said convex corner is received in a recess in a respective refractory brick of a single said layer.

14. The improvement claimed in claim 12, wherein said convex corner is received in a concave corner formed by surfaces of refractory bricks of two adjacent said layers.

15. The improvement claimed in claim 12, wherein said vertical side surface extends downwardly from the respective said upper inclined surface.

16. The improvement claimed in claim 12, wherein said vertical side surface extends downwardly from an upper horizontal surface that joins the respective said upper inclined surface and vertical side surface.

17. The improvement claimed in claim 2, wherein said upper and lower inclined surfaces of each said relief brick extend parallel to each other.

18. The improvement claimed in claim 2, wherein each said upper and lower inclined surface includes a first portion having a shallow incline with respect to the horizontal and a second portion having a steep incline with respect to the horizontal.

19. The improvement claimed in claim 2, wherein each said relief brick has a total vertical height equal to the height of two of said layers of refractory bricks.

20. The improvement claimed in claim 2, wherein each said relief brick has a total vertical height between one and two times the height of a said layer of refractory bricks.

* * * * *